US011566420B2

(12) United States Patent
Kim

(10) Patent No.: US 11,566,420 B2
(45) Date of Patent: Jan. 31, 2023

(54) ASSEMBLY-TYPE BRICK SET

(71) Applicant: Tai-Myong Kim, Siheung-si (KR)

(72) Inventor: Tai-Myong Kim, Siheung-si (KR)

(73) Assignee: Kim Tai-Myong, Siheung-si (KR)

( * ) Notice: Subject to any disclaimer, the term of this patent is extended or adjusted under 35 U.S.C. 154(b) by 0 days.

(21) Appl. No.: 17/292,560

(22) PCT Filed: Oct. 8, 2019

(86) PCT No.: PCT/KR2019/013232
§ 371 (c)(1),
(2) Date: May 10, 2021

(87) PCT Pub. No.: WO2020/101179
PCT Pub. Date: May 22, 2020

(65) Prior Publication Data

US 2022/0002993 A1 Jan. 6, 2022

(30) Foreign Application Priority Data

Nov. 12, 2018 (KR) ..... 10-2018-0137836

(51) Int. Cl.
*E04B 2/18* (2006.01)
*E04B 2/24* (2006.01)
(Continued)

(52) U.S. Cl.
CPC ..... *E04B 2/18* (2013.01); *E04B 2/24* (2013.01); *E04B 1/4185* (2013.01); *E04B 2002/0243* (2013.01)

(58) Field of Classification Search
CPC . E04B 1/4185; E04B 2/18; E04B 2/24; E04B 2/26; E04B 2002/0243
(Continued)

(56) References Cited

U.S. PATENT DOCUMENTS 1,020,645 A * 3/1912 Hall ..... E04B 2/16 52/592.6
1,197,363 A * 9/1916 Francis ..... E04B 2/16 52/433
(Continued)

FOREIGN PATENT DOCUMENTS

CN 112359981 A * 2/2021 ..... E04B 1/21
KR 20040019582 3/2004
(Continued)

OTHER PUBLICATIONS

Office Action for Chinese Patent Application No. 201980074226.7, dated Jan. 26, 2022.
(Continued)

*Primary Examiner* — Brian D Mattei
*Assistant Examiner* — Joseph J. Sadlon

(57) ABSTRACT

The present invention is an assembly-type brick set. More specifically, the present invention is an assembly-type brick set which not only maximizes structural rigidity and fastening performance but is also able to, by excluding use of brittle bonding agent such as concrete mortar, prevent damage and collapse of a wall even in cases of severe shaking, such as during earthquakes. This assembly-type brick set comprises a brick portion in which is formed at least one brick hole which penetrates a brick body vertically, and a joint which is inserted into the brick hole, wherein: the brick hole is formed in the shape of an hour glass wherein the diameter of a middle portion is smaller than a top diameter and a bottom diameter; the joint is formed so that its top portion fits into the bottom of the brick hole, and its bottom portion fits into the top of the brick hole; a plurality of brick portions is provided stacked vertically adjacent to each other; and, an assembled brick structure is achieved by
(Continued)

inserting the joint between the adjacently stacked brick portions.

12 Claims, 14 Drawing Sheets

(51) Int. Cl.
*E04B 1/41* (2006.01)
*E04B 2/02* (2006.01)

(58) Field of Classification Search
USPC ..... 52/606
See application file for complete search history.

(56) References Cited

U.S. PATENT DOCUMENTS 1,657,861 A * 1/1928 Lucas ..... E04B 2/42 52/505
2,261,510 A * 11/1941 Atcheson ..... E04B 1/703 52/564
3,292,329 A * 12/1966 Garancsy ..... E04B 2/16 52/274
3,394,517 A * 7/1968 Caterina ..... E04B 2/08 52/436
3,430,404 A * 3/1969 Muse ..... E04B 2/46 52/439
3,537,687 A * 11/1970 Adelman ..... E02D 29/0266 47/33
3,759,003 A * 9/1973 Wilson ..... E04B 2/12 52/285.4
3,780,484 A * 12/1973 Muse ..... E04B 2/14 52/568
4,454,699 A * 6/1984 Strobl ..... F16B 21/082 411/510
5,024,035 A * 6/1991 Hanson ..... E04B 2/18 52/591.1
6,088,987 A * 7/2000 Simmons ..... E04B 2/14 52/592.4
6,205,726 B1 * 3/2001 Hoadley ..... E04B 2/16 52/592.6
6,205,735 B1 * 3/2001 Witcher ..... E04B 2/46 52/592.1
6,282,859 B1 * 9/2001 Van Der Heijden ..... E04B 2/08 52/223.7
6,536,168 B1 * 3/2003 Cugini ..... E04B 5/48 52/220.5
7,404,274 B2 * 7/2008 Hayes ..... E04C 5/07 52/513
8,448,410 B2 * 5/2013 Korman ..... E04B 2/16 52/750
8,667,759 B2 * 3/2014 Hammer ..... E04C 1/395 52/575
8,931,223 B2 * 1/2015 Speer ..... E04B 2/16 52/583.1
9,593,480 B2 * 3/2017 Vandenbempt ..... E04B 2/26
10,590,643 B2 * 3/2020 Parkes ..... E04B 5/32
10,648,176 B2 * 5/2020 Olarte Michel ..... E04B 2/08
10,941,561 B2 * 3/2021 Miller ..... E04F 13/0855
2008/0098687 A1 * 5/2008 Marsh ..... E04B 2/16 411/84
2008/0250736 A1 * 10/2008 Breaz ..... E04C 1/41 52/309.4
2008/0302046 A1 * 12/2008 Burgess ..... E04B 2/16 52/434
2011/0041447 A1 * 2/2011 Philipp ..... E04B 2/16 52/704
2011/0072751 A1 * 3/2011 Clear ..... E04C 5/168 52/678

FOREIGN PATENT DOCUMENTS

KR 200400173 11/2005
KR 20110088290 8/2011
KR 101174065 B1 * 10/2011 ..... B28B 3/00
KR 20150024458 3/2015
RU 2175702 C2 10/2001

OTHER PUBLICATIONS

Office Action for Indian Patent Application No. 202117024495, dated Mar. 23, 2022.
Office Action for Korean Patent Application No. 10-2018-0137836, dated Apr. 29, 2020.
Office Action for Russian Patent Application No. 2021116833, dated Nov. 16, 2021.

* cited by examiner

【FIG. 1】
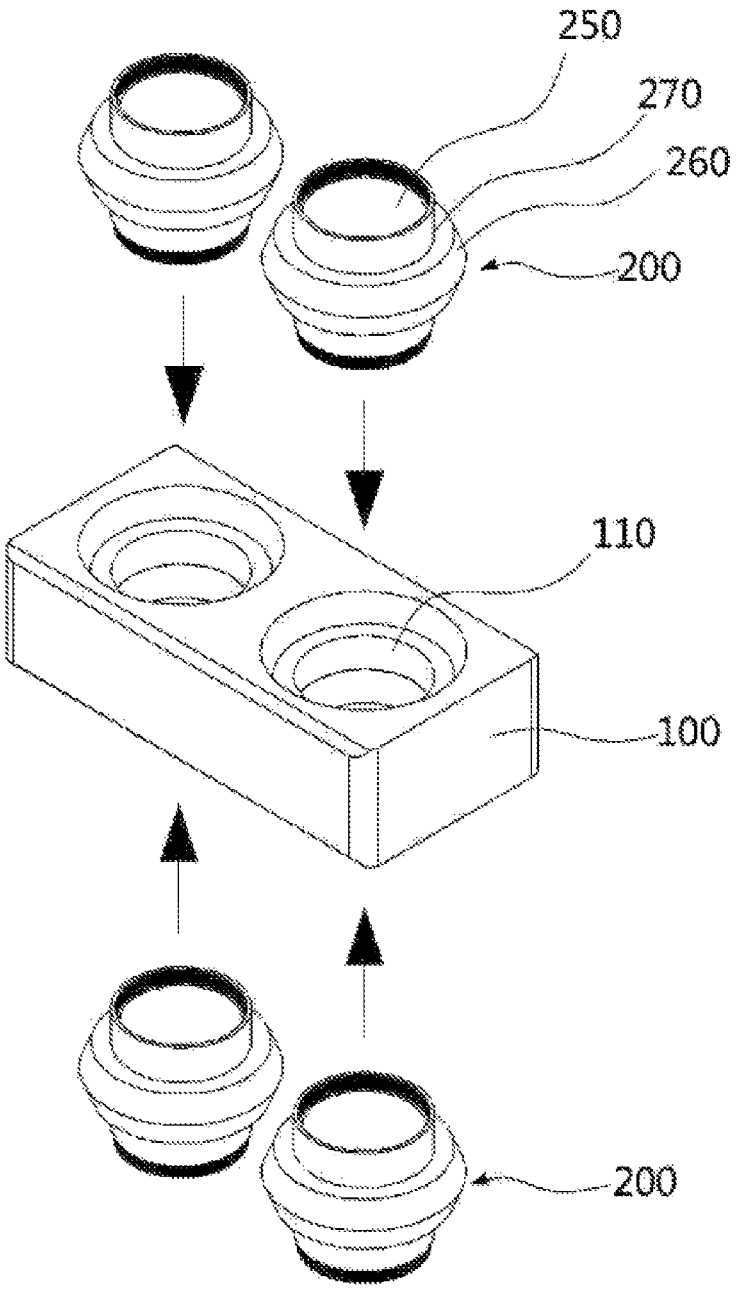

【FIG. 2】
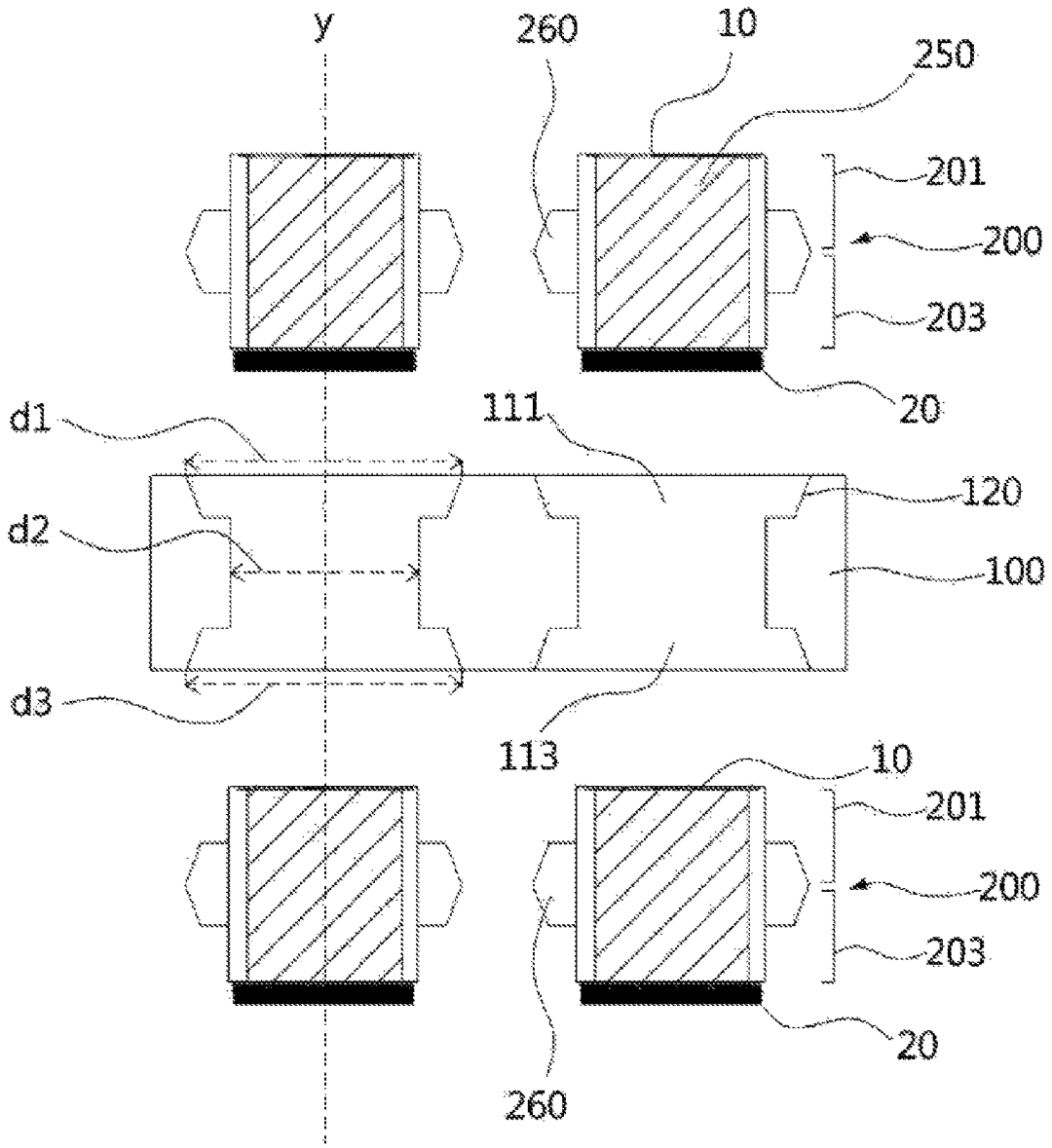

【FIG. 3】
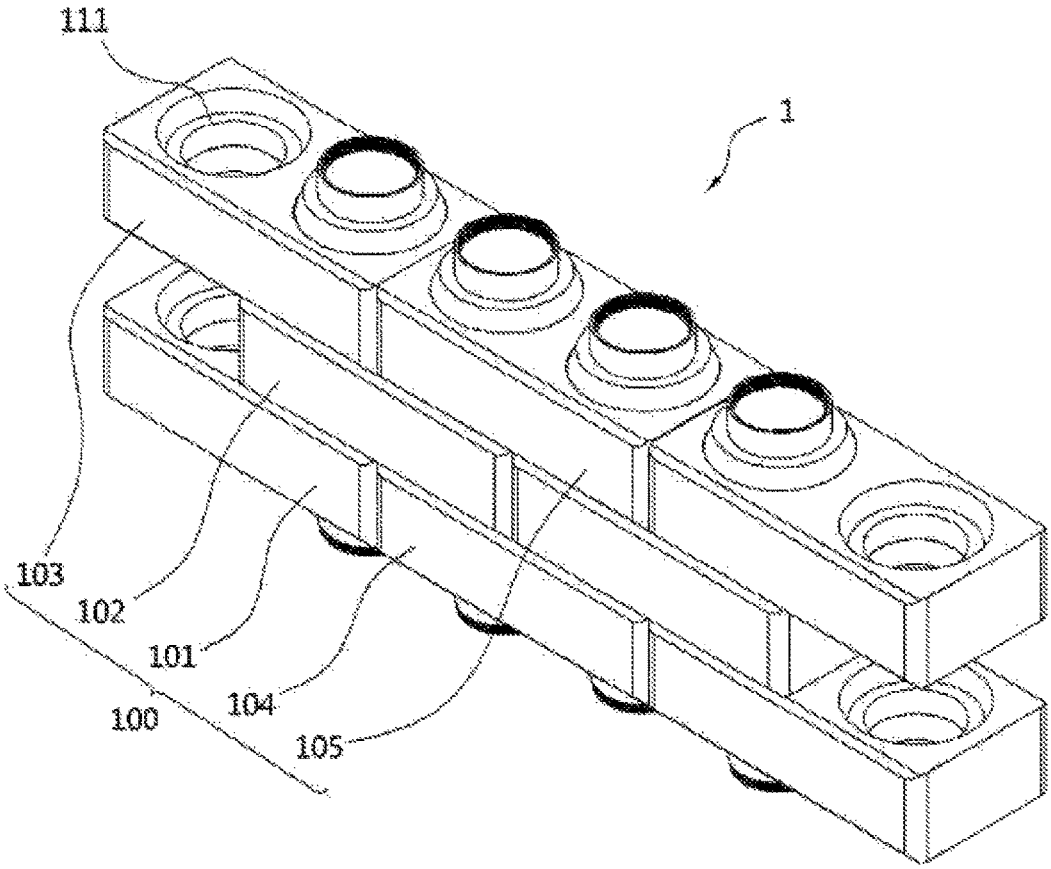

【FIG. 4】
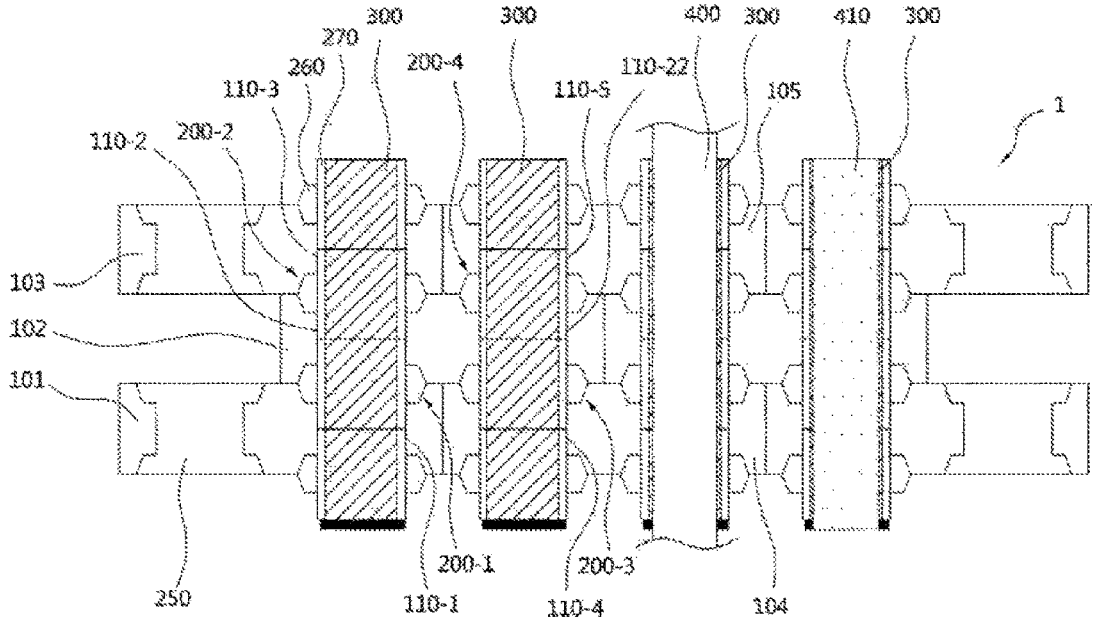

【FIG. 5】
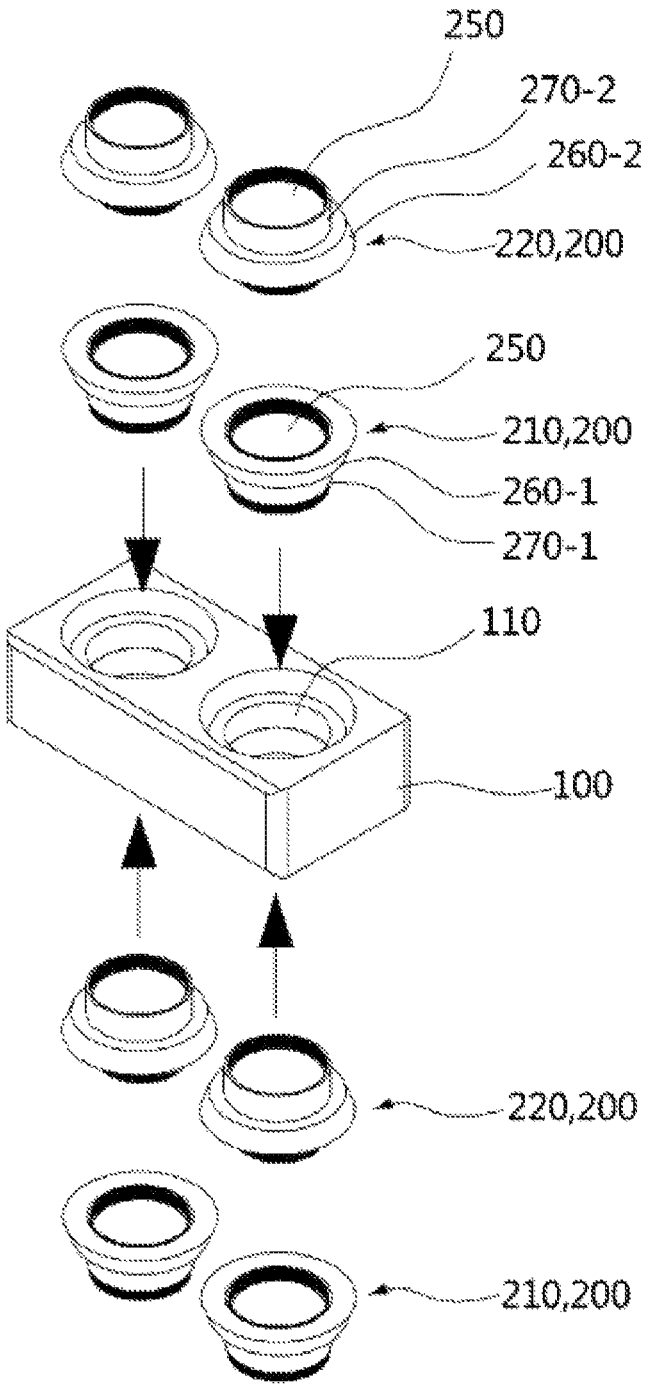

【FIG. 6】
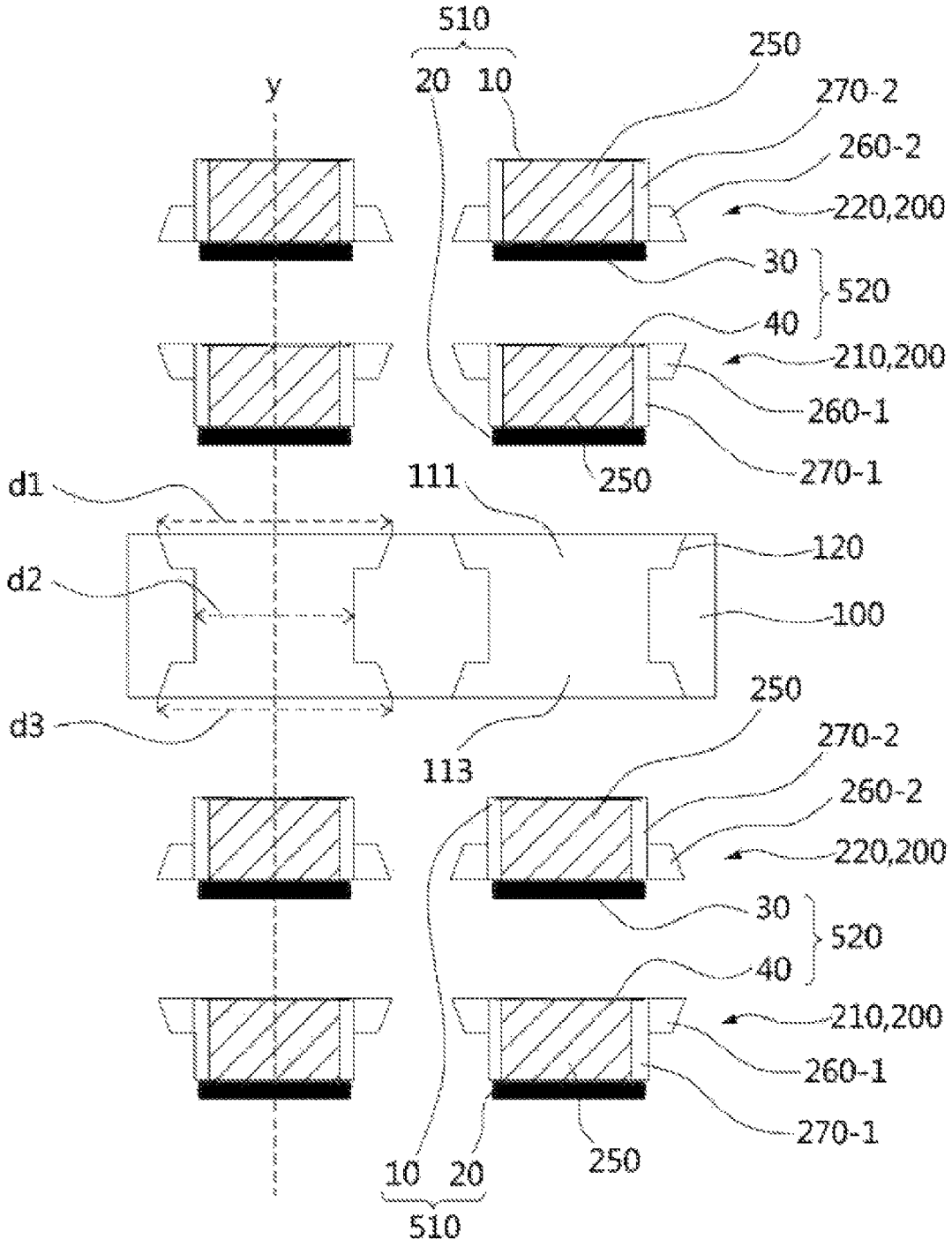

【FIG. 7】
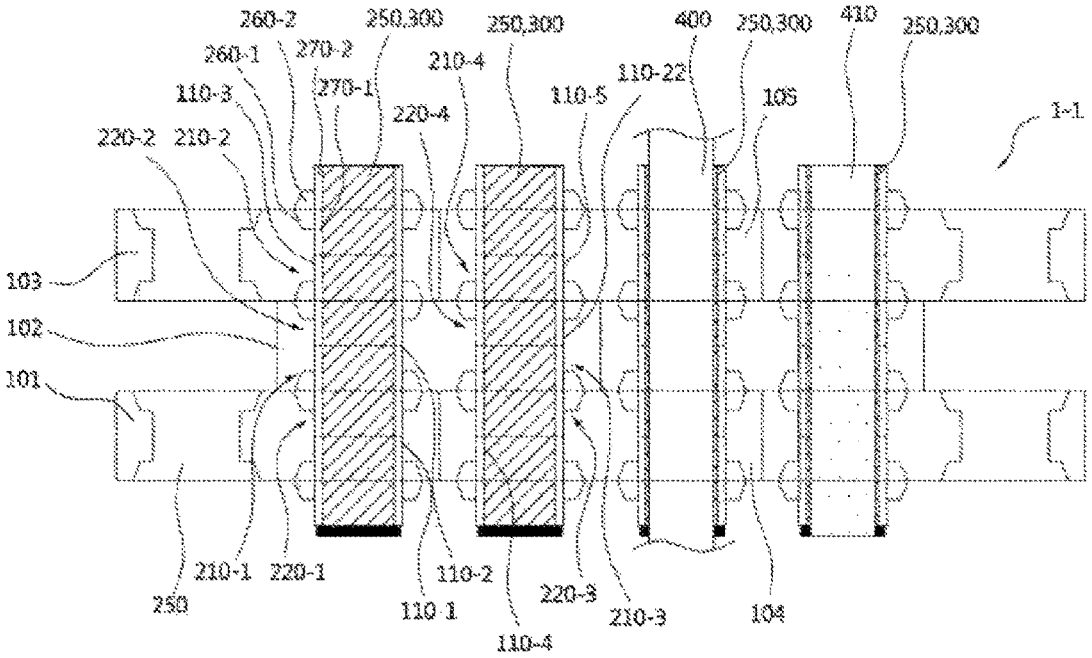

【FIG. 8】
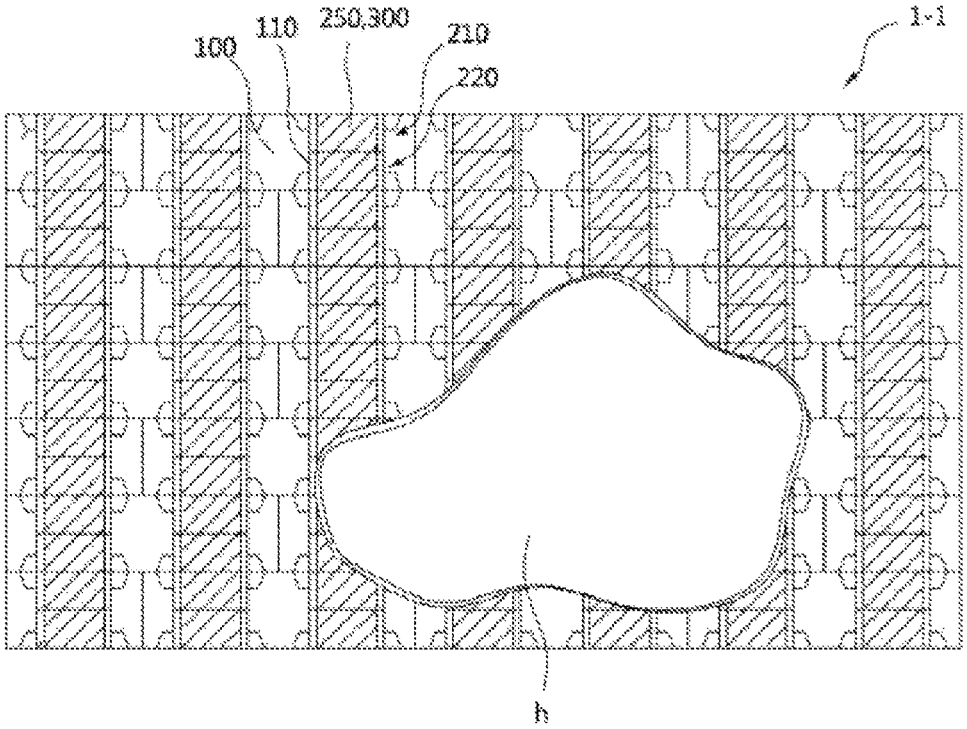

【FIG. 9】
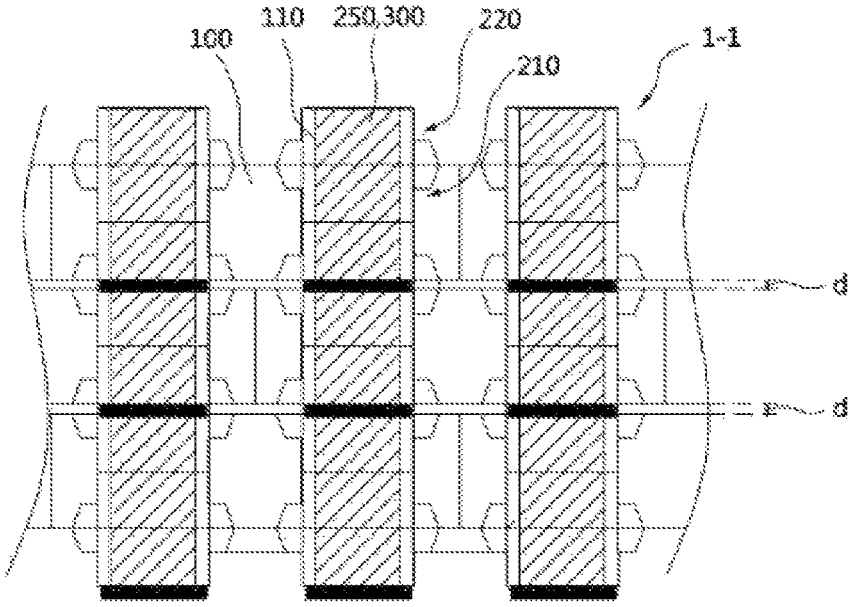

【FIG. 10】
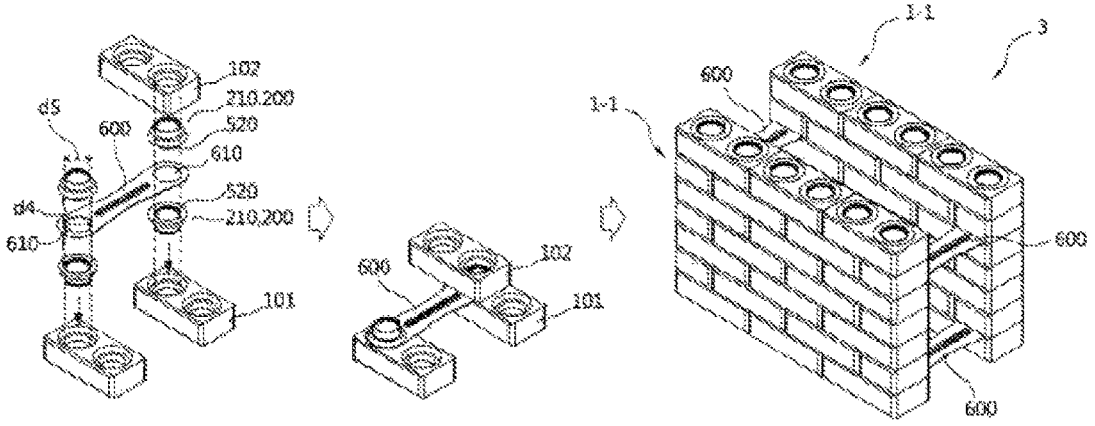

【FIG. 11】
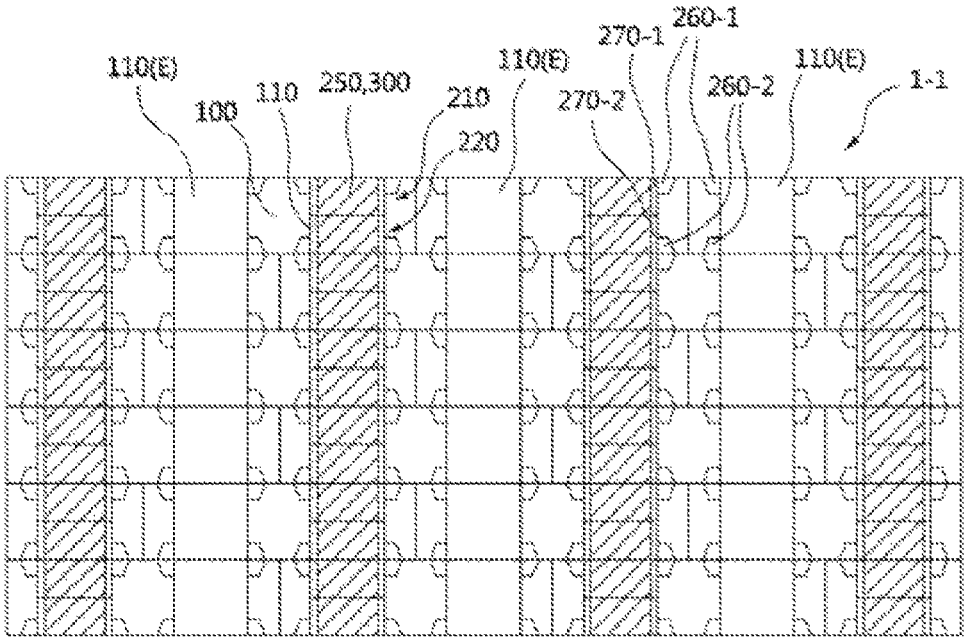

【FIG. 12】
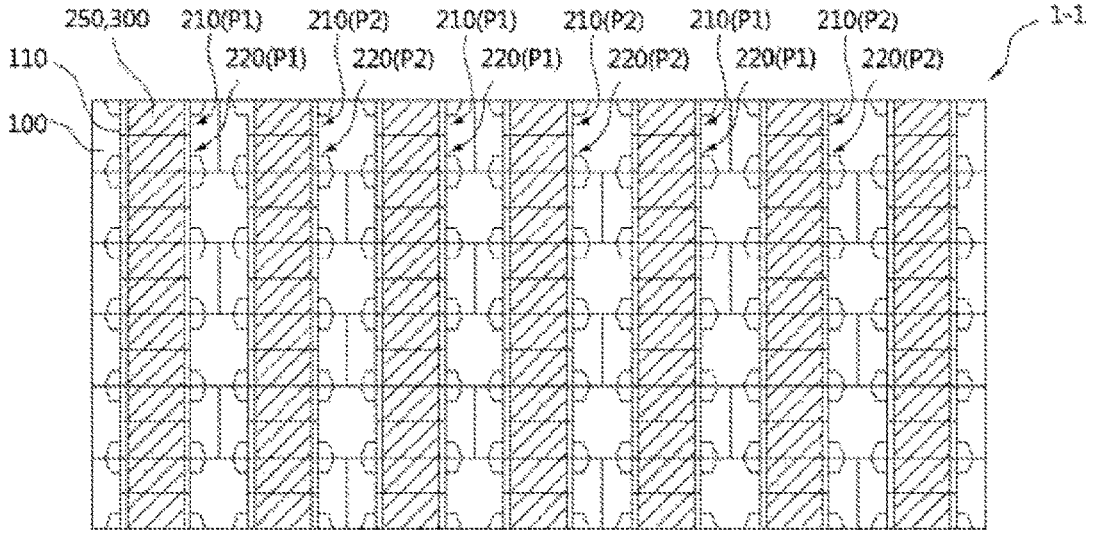

【Fig.13】
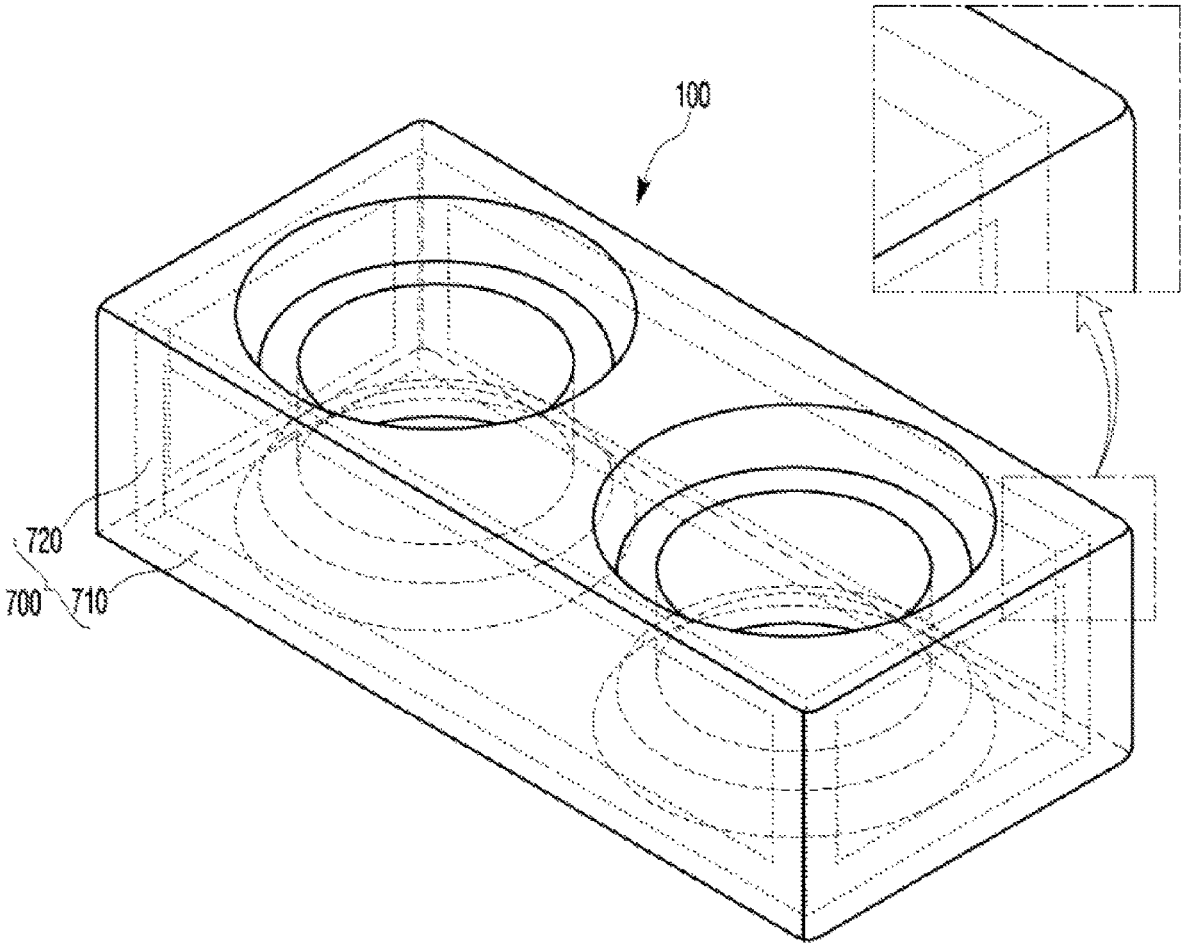

【Fig.14】
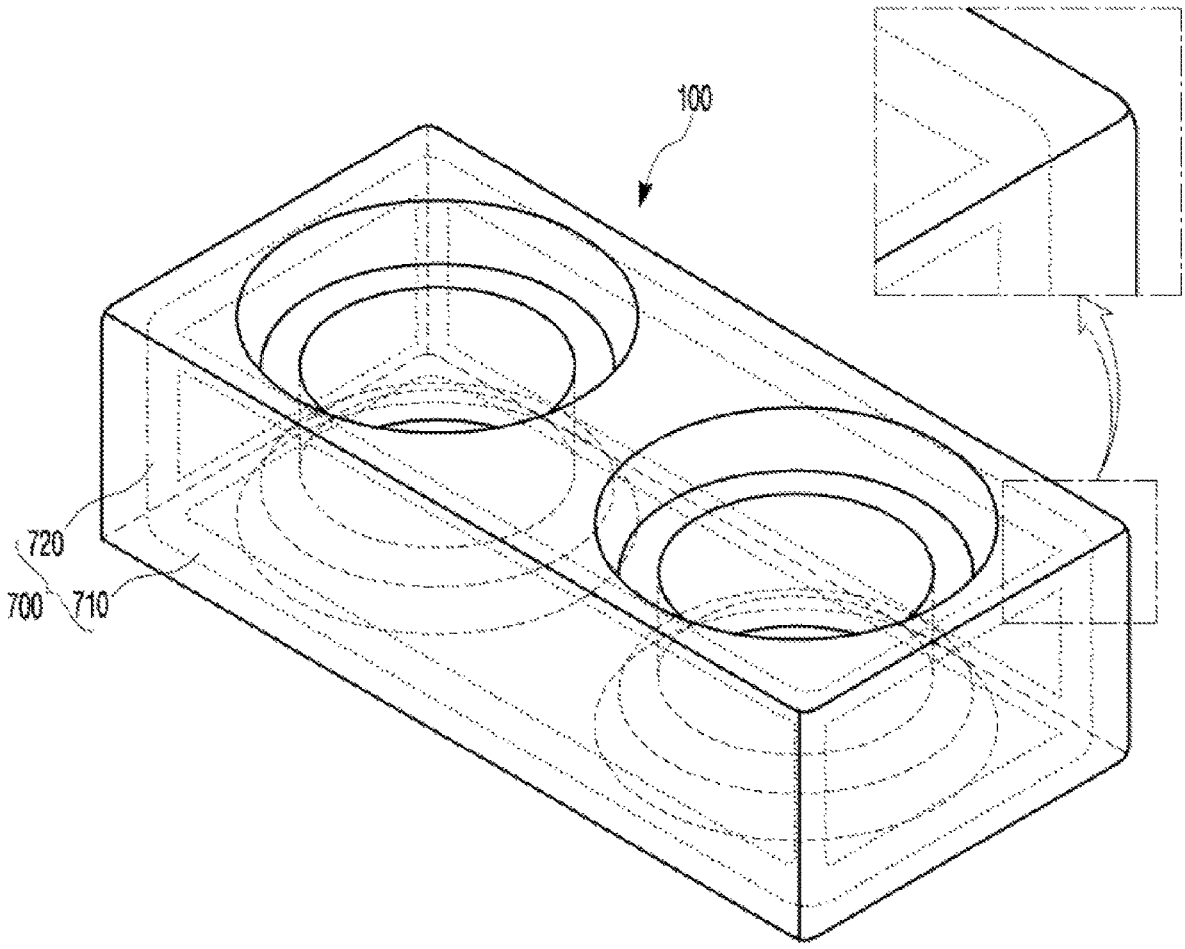

ASSEMBLY-TYPE BRICK SET

TECHNICAL FIELD

The present invention is an assembly-type brick set. More specifically, the present invention is an assembly-type brick set wherein a brick structure is formed through assembly by inserting a joint into a brick hole in a brick portion.

BACKGROUND ART

Brick is a material which has been consistently favored in the building of homes, buildings and other structures. Brick structures are also widely used for interiors, and research is underway for easier, safer and more economic ways of constructing brick structures.

Well-known conventional techniques of constructing brick structures include stacking bricks using methods such as running bond or common bond, then applying cement mortar or other bonding agent between the bricks to bond them.

However, these methods require substantial technique and construction time, and are extremely difficult for an unskilled person to perform.

In particular, careful work by a trained expert is necessary for evenly stacking the bricks into the desired, shape, evenly applying cement mortar, and otherwise keeping the stacked bricks horizontal and maintaining even spacing between bricks.

A further problem is that it is difficult to separate bricks which have been bonded, making it difficult to reuse bricks when a constructed wall is dismantled.

Further, cement mortar, etc. is prone to cracking in response to external impact, meaning that damage to part of a brick structure can cause the entire brick structure to collapse. In response, various means of improving stability have been sought.

One example of such prior art is Korean Laid-Open Patent No. 10-2001-0085068.

DETAILED DESCRIPTION OF THE INVENTION

Technical Issues

A purpose of the present invention, which has been devised to solve the above-stated problems, is to provide an assembly-type brick set which allows even an unskilled person to construct a brick structure.

Another purpose of the present invention is to provide an assembly-type brick set which can reduce the construction time of a brick structure and improve efficiency.

Another purpose of the present invention is to provide an assembly-type brick set which allows for construction of a brick structure without using a bonding agent.

Another purpose of the present invention is to provide an assembly-type brick set which is able to improve the structural rigidity and fastening performance of a brick structure.

Another purpose of the present invention is to provide an assembly-type brick set whereby when a constructed brick structure is dismantled, bricks can be recycled.

Technical Solution

The present invention of an assembly-type brick set is devised to achieve the above-stated purposes, and comprises a brick portion in which is formed at least one brick hole which penetrates a brick body vertically, and a joint which is inserted into the brick hole, wherein the brick hole is formed in the shape of an hour glass wherein the diameter of a middle portion is smaller than a top diameter and a bottom diameter; the joint is formed so that its top portion fits into the bottom of the brick hole, and its bottom portion fits into the top of the brick hole; the brick portion is provided in plurality, including a first brick portion and a second brick portion which are vertically stacked adjacent to each other; and an assembled brick structure is achieved by inserting the bottom of the joint into the top of any one of the brick holes formed on the first brick portion, and inserting the top of the joint into the bottom of any one of the brick holes formed on the second brick portion.

Further, intermeshing fastening structures may be provided at the top and bottom of the joint, so that the bottom of the joint inserted into the top of the brick hole and the top portion of the joint inserted into the bottom of the brick hole are fastened vertically to each other in the interior of the brick hole.

Further, the brick hole may be formed with vertical symmetry, with the joint comprised of an upper joint which fits into the upper portion of the brick hole and a lower joint which fits into the lower portion of the brick hole, where intermeshing fastening structures are provided at the top and bottom of the upper joint and the lower joint, respectively; and the bottom portion of the upper joint and the top portion of the lower joint intermesh and are fastened to each other in the interior of the brick portion, and the top portion of the upper joint and the bottom portion of the lower joint intermesh and are fastened to each other outside the brick portion.

Further, the inner face of the brick portion surrounding the brick hole may be sloped in a certain section between the top and middle or between the bottom and middle of the brick hole, so that the width of the brick hole gradually decreases along the slope from the top or bottom of the brick hole toward the middle.

Further, the brick hole may be formed with axial symmetry about a vertical axis.

Further, the fastening structure may be achieved by means of intermeshing prominences and depressions, or by means of intermeshing screws and threads.

Further, a joint hole which penetrates the joint vertically may be provided, and a joint path may be formed by connecting the joint holes provided on two different joints which are fastened vertically.

Further, a supporting pole which is inserted vertically in the joint path may be provided.

Further, a thin plate-shaped linking member on which is formed a pair of link holes penetrating either end may be provided, the linking member is provided between the first brick portion and the second brick portion so that the joint penetrates the link hole and is assembled to the first brick portion and the second brick portion; and in an arrangement in which a pair of brick structures are arranged side by side, the pair of link holes are respectively assembled to the same level of each of the pair of brick structures, thereby linking the pair of brick structures and achieving a double brick structure.

Further, the linking member may be length-adjustable.

Further, the brick portion may comprise horizontal cores which are embedded inside the top and bottom portion along the horizontal circumference, and vertical cores which connect and support the embedded horizontal cores, where the vertical cores are embedded at the vertical corners of the brick portion.

Further, the joint may comprise a column-shaped joint body and a ring-shaped joint ring, with the joint body penetrating the joint ring.

Benefits of the Invention

With this assembly-type brick set, even an unskilled person is able to readily construct a stable brick structure, enhancing convenience and efficiency of construction work.

Further, by reducing time required in constructing a brick structure, convenience and efficiency of construction can be increased.

Further, by allowing construction of a brick structure without use of a bonding agent, convenience and efficiency of construction can be increased.

Further, as bricks can be recycled when a constructed brick structure is dismantled, an assembly-type brick set with improve economy and which prevents waste can be provided.

Further, an assembly-type brick set which has high resistance to pressure, low failure rate, and outstanding durability can be provided.

Further, by naturally centering a link when a joint and a brick portion are assembled, convenience can be provided to a builder.

Further, the number of joints assembled and their material may be adjusted depending on the budget and the necessary strength of a wall structure.

Further, by inserting a joint ring excluding a joint body into the brick hole, cost savings can be achieved while causing the inner space of the brick hole to have a cylindrical shape and using the inner space as a path.

Further, the inner space in a constructed brick structure may be used as a path for water pipes, sewage pipes or wires, improving space utilization.

Further, by inserting a supporting pole in the inner space of a constructed brick structure, or filling the inner space with a bonding agent such as concrete mortar, the structural rigidity of a brick structure may be improved.

Further, as a constructed brick structure may be fixed to a floor or a ceiling without using a bonding agent such as concrete mortar, the work may be carried out readily even by an unskilled person, and also efficiency of work and the fastening performance of a brick structure may be improved.

Accordingly, damage or demolition of a brick structure may be prevented even in cases of severe shaking such as during earthquakes.

Further, as the positions of the respective brick portions making up a constructed brick structure are stably secured, the brick structure may remain stable without collapsing even when part of the brick structure is damaged.

Further, by adjusting the spacing between the link holes, the spacing between brick structures can be readily adjusted, and each layer can be readily made level.

Further, by forming a double brick structure and filling the space in between with insulation material, etc., the functionality of a brick structure can be improved.

BRIEF DESCRIPTION OF DRAWINGS

FIG. 1 is a skew drawing of the assembly-type brick set according to a first prototype of the present invention.

FIG. 2 is a schematic representation of the assembly-type brick set according to a first prototype of the present invention.

FIG. 3 is a skew drawing of a brick structure assembled using this assembly-type brick set.

FIG. 4 is a rough cross section of the brick structure according to a first prototype of the present invention.

FIG. 5 is a skew drawing of the assembly-type brick set according to a second prototype of the present invention.

FIG. 6 is a schematic representation of the assembly-type brick set according to a second prototype of the present invention.

FIG. 7 is a rough cross section of the brick structure according to a second prototype of the present invention.

FIG. 8 is a rough cross section showing a case wherein a brick structure assembled using this assembly-type brick set has been damaged.

FIG. 9 is a cross section roughly illustrating a case wherein the spacing between brick structures assembled using this assembly-type brick set is adjusted.

FIG. 10 is a skew drawing illustrating a case wherein a pair of brick structures assembled using this assembly-type brick set forms a double brick structure.

FIG. 11 is a cross section roughly illustrating a brick structure according to the present invention wherein joints are assembled to only part of the brick holes.

FIG. 12 is a cross section roughly illustrating a brick structure according to the present invention wherein link holes of a plurality of materials are assembled.

FIG. 13 is a skew drawing illustrating a case wherein a plate-type core is embedded in a brick portion according to the present invention.

FIG. 14 is a skew drawing illustrating a case wherein a cylinder-type core is embedded in a brick portion according to the present invention.

| *Explanation of Key Symbols in the Drawings* | |
|---|---|
| d: Fastening interval, stacking interval | d1: Upper diameter of brick hole |
| d2: Middle diameter of brick hole | d3: Lower diameter of brick hole |
| h: Hole | 1, 1-1: Brick structure |
| 3: Dual brick structure | 10: Top of joint, top of upper joint |
| 20: Bottom of joint, bottom of lower joint | 30: Bottom of upper joint |
| 40: Top of lower joint | 100: Brick portion |
| 101: First brick portion | 102: Second brick portion |
| 103: Third brick portion | 104: Fourth brick portion |
| 105: Fifth brick portion | 110: Brick hole |
| 111: Upper portion of brick hole | 113: Lower portion of brick hole |
| 110-1: First brick hole | 110-2: Second brick hole |
| 110-22: Second brick hole-1 | 110-3: Third brick hole |
| 110-4: Fourth brick hole | 110-5: Fifth brick hole |
| 200: Joint | 200-1: First joint |
| 200-2: Second joint | 200-3: Third joint |
| 200-4: Fourth joint | 210: Upper joint |
| 220: Lower joint | 210-1: First upper joint |
| 210-2: Second upper joint | 210-3: Third upper joint |
| 210-4: Fourth upper joint | 220-1: First lower joint |
| 220-2: Second lower joint | 220-3: Third lower joint |
| 220-4: Fourth lower joint | 250: Joint hole |
| 300: Joint path | 400: Supporting pole |
| 410: Adhesive | 510: Internal fastener |
| 520: External fastener | 600: Linking member |
| 610: Link hole | 700: Core |
| 710: Horizontal core | 720: Vertical core |

BEST MODE(S) FOR CARRYING OUT THE INVENTION

In the following, the configuration and operation of this assembly-type brick set will be explained in detail with reference to the attached drawings.

A first prototype of this assembly-type brick set will be explained with reference to FIG. 1 through FIG. 4.

The assembly-type brick set according to a first prototype of the present invention is comprised of a brick portion (100) in which at least one brick hole (110) penetrating the brick body vertically is formed, and a joint (200) which fits into the brick hole (110).

FIG. 1 is a skew drawing of the assembly-type brick set according to a first prototype of the present invention, and FIG. 2 is a schematic representation of the assembly-type brick set according to a first prototype of the present invention.

The brick portion (100) may be formed in various shapes, for example, as a rectangular parallel pipe with a length of approximately 200 mm, a width of approximately 100 mm, and a height of approximately 50 mm.

On the brick portion (100), a pair of the brick holes (110) may be provided side by side in a lengthwise direction.

The brick hole (110) may be provided in an hourglass shape wherein the middle diameter (d2) is less than the upper diameter (d1) and lower diameter (d3), and the joint (200) is provided so that its upper portion (201) fits into the lower portion (113) of the brick hole (110), and its lower portion (203) fits into the upper portion (111) of the brick hole (110).

Accordingly, different joints (200) are inserted into the upper portion (111) and lower portion (113) of the brick hole (110), with the different joints (200) meeting at the middle of the brick hole (110).

Here, intermeshing fastening structures may be provided at the top (10) and bottom (20) of the joint (200), so that the different joints (200) are fastened vertically inside the brick hole (110).

The fastening structure may be achieved by means of intermeshing prominences and depressions, or by means of intermeshing screws and threads.

The fastening structure may be welded after fastening.

Further, the inner face of the brick portion (100) around the brick hole (110) may be sloped. The slope may occupy a certain section between the top (111) and middle or between the bottom (113) and middle of the brick hole (110), so that the width of the brick hole (110) gradually decreases along the slope from the top (111) or bottom (113) of the brick hole toward the middle.

Further, the brick hole (110) may be an axially symmetric form about a vertical axis (y), and the joint (200) which fits into the same may be an axially symmetric form rotated about a vertical axis (y).

Accordingly, when the joint (200) is inserted into the brick hole (110), the joint (200) naturally rotates toward the center along the slope (120) and is centered without the need to aim or do otherwise, providing convenience to a worker.

The joint (200) may be made of various materials, such as plastic, stainless steel, aluminum or iron, and these may be selectively applied depending on the budget or desired strength.

Further, the joint (200) may be comprised of a cylindrical joint body (270) and a ring-shape joint ring (260), with the joint body (270) penetrating the joint ring (260).

The joint body (270) may have a vertically penetrating joint hole (250), where the joint hole (250) has a cylindrical shape.

FIG. 3 is a skew drawing of a brick structure assembled using this assembly-type brick set, and FIG. 4 is a rough cross section of the brick structure according to a first prototype of the present invention.

A plurality of brick portions (100) may be provided and stacked adjacently to each other.

The plurality of brick portions (100) is assembled with at least one of the joints (200) in the process of stacking, in order to form a brick structure (1) of various forms.

The plurality of brick portions (100) may be stacked in a number of different methods. For example, these may be stacked in a running bond method wherein the length of the brick is visible from outside, and each brick overlaps its vertically adjacent bricks by half a brick's length.

The plurality of brick portions (100) comprises a first brick portion (101) and a second brick portion (102) which are stacked sequentially from the bottom up, whereby the brick structure (1) is assembled by inserting the bottom portion of the first joint (200-1) into the top of the first brick hole (110-1) which is any one of the brick holes (110) provided on the first brick portion (101), then inserting the top portion of the first joint (200-1) into the bottom of the second brick hole (110-2) which is any one of the brick holes (110) provided on the second brick portion (102).

Further, the plurality of brick portions (100) may comprise a third brick portion (103) which is stacked adjacent to and on top of the second brick portion (102), where the brick structure (1) may be assembled by inserting the bottom portion of the second joint (200-2) into the top portion of the second brick hole (110-2) and inserting the top portion of the second joint (200-2) into the bottom of the third brick hole (110-3) which is any one of the brick holes (110) provided on the third brick portion (103).

Accordingly, the first brick hole (110-1), the second brick hole (110-2) and the third brick hole (110-3) come to be positioned along the same vertical line, with the first joint (200-1) and the second joint (200-2) inserted into the respective brick holes (110-1, 110-2, 110-3) also positioned along the same vertical line to function as a vertical column of the brick structure (1).

Further, the plurality of brick portions (100) may further comprise a fourth brick portion (104) and a fifth brick portion (105) which are respectively positioned beneath and above the second brick portion (102).

The fourth brick portion (104) and the fifth brick portion (105) may form a structure which is symmetrical with the first brick portion (101) and the third brick portion (103), and may be assembled to the second brick portion (102) through a third joint (200-3) and a fourth joint (200-4), respectively.

Accordingly, a second brick hole- 1 (110-22) which is the other of the brick holes (110) provided on the second brick portion (102), comes to be positioned along the same vertical line as the fourth brick hole (110-4), which is any one of the brick holes (110) provided on the fourth brick portion (104), and the fifth brick hole (110-5), which is any one of the brick holes (110) provided on the fifth brick portion (105), and the third joint (200-3) assembled between the fourth brick hole (110-4) and the second brick hole 1 (110-22) and the fourth joint (200-4) assembled between the second brick hole- 1 (110-22) and the fifth brick hole (110-5) are also positioned along the same vertical line and come to function as a vertical column of the brick structure (1).

Further, the vertical column is comprised of the first joint (200-1) and the second joint (200-2), and the vertical column comprised of the third joint (200-3) and the fourth joint (200-4) linked in a horizontal direction by the second brick portion (102).

As explained in the foregoing, by repeating a process in which a plurality of the brick portions (100) are stacked in a certain method and wherein at least one of the joints (200) is inserted in between each layer, brick structures (1) of various shapes may be formed.

As such, through use of this assembly-type brick set, brick structures (1) of various shapes may be formed through repetition of a simple assembly procedure, providing the advantage of easy installation even by a non-skilled person.

Further, with the joints (200) linked vertically and serving as vertical columns of the brick structure (1), and the brick portion (100) horizontally linking the joints (200) which are provided side by side to each other, a stable brick structure with a weave structure may be formed.

Further, as the joints (200) are fastened vertically and hold the brick portion (100) and the joint (200) in place, the brick structure (1) may be completed without the use of a bonding agent, which may be optional.

Accordingly, the provided assembly-type brick set can be readily installed even by a non-skilled person, and by improving worker convenience and reducing the time required for constructing a brick structure, efficiency is enhanced.

Further, as it is possible to prevent damage to components in the process of removing a bonding agent when the brick structure (1) is dismantled, reuse of bricks and efficiency may be improved.

Further, the joint holes (250) are linked to each other by the formation of the vertical column, and form a joint path (300) of vertically communicating joints.

The joint path (300) may extend from the top end to the bottom end of the brick structure (1).

The joint path (300) may be used as a path for water or sewage pipes or wires, improving space utilization.

Further, a supporting pole (400) suitable for the diameter and height of the joint path (300) may be provided and inserted into the joint path (300).

The supporting pole (400) may be made of highly rigid material such as reinforcement bar or concrete, and its insertion into the joint path (300) to link the joints vertically may further reinforce their column role.

Further, a bonding agent (410) such as cement mortar may be provided and used to fill the joint path (300), and such a bonding agent filling the joint path (300) may perform the same role as the supporting pole (400).

Further, in a case in which the brick structure (1) is a wall which is in contact with another wall or a ceiling, the brick structure may be fixed in place by applying a bonding agent between the ceiling and the topmost portion of the wall or between the floor and the bottommost portion of the wall.

Here, the bonding agent may be applied not on the brick portion of the wall, but be linked with the bonding agent which fills the joint hole (250) inside the joint (200) at the topmost or bottommost portion of the wall.

Further, the wall may be held in place without the use of a bonding agent, by securing the joints (200) at the topmost or bottommost portion of the wall directly to the ceiling or floor, respectively.

For example, if a case where a ceiling or floor is made of metal, the joint (200) at the topmost or bottommost portion of the wall may be secured by being welded to the ceiling or floor, and in a case where a ceiling or floor is made of wood, a wooden core may be hammered into the ceiling or floor, and the wall may be secured in place by inserting such a core into the joint hole (250) inside the joint (200) at the topmost or bottommost portion of the wall.

As such, this assembly-type brick set enables a brick structure (1) to be fixed to the floor or ceiling of a building without use of a bonding agent such as cement mortar, allowing work to be carried out readily even by a non-skilled person while also improving work efficiency and improving the security of brick structures.

Further, by preventing damage to components of a brick structure (1) in the process of removing a bonding agent during dismantling, reuse of bricks and efficiency can be improved.

A second prototype of the assembly-type brick set of the present invention will be explained below with reference to FIG. 5 through FIG. 7.

The assembly-type brick set according to a second prototype of the present invention is identical to the configuration of the first prototype, but differs from the first prototype in that the brick hole (110) of the brick portion (100) has vertical symmetry, and the joint (200) comprises an upper joint (210) which fits into an upper portion (111) of the brick hole (110) and a lower joint (220) which fits into a lower portion (113) of the brick hole (110).

FIG. 5 is a skew drawing representing the brick portion (100) and the joint (200) comprised of the upper joint (210) and the lower joint (220), and FIG. 6 is a cross section representing the brick portion and the joint (200) comprised of the upper joint (210) and the lower joint (220).

The upper joint (210) may be comprised of an upper joint body (270-1) and an upper joint ring (260-1), and the lower joint (220) may be comprised of a lower joint body (270-2) and a lower joint ring (260-2).

Intermeshing fastening structures are provided at the upper end and lower end of the upper joint (210) and the lower joint (220).

Accordingly, the bottom portion (20) of the upper joint (210) and the top portion (10) of the lower joint (220) form an internal fastener (510) wherein they intermesh and are fastened to each other inside the brick hole (110) of the brick portion (100), and the top portion (40) of the upper joint (210) and the bottom portion (30) of the lower joint (220) form an external fastener (520) wherein they intermesh and are fastened to each other outside the brick portion (100).

The fastening structure of the internal fastener (510) and the external fastener (520) may be achieved by means of intermeshing prominences and depressions, or by means of intermeshing screws and threads.

According to the present second prototype, the top face of the upper joint (210) inserted in to the brick hole (110) is positioned along the top face of the brick portion (100), and the bottom face of the lower joint (220) is positioned along the bottom face of the brick portion (100). This allows for easier and more efficient work in finishing the edges of a brick structure (1-1).

FIG. 7 is a cross section of the brick structure (1-1).

The brick structure (1-1) is achieved by inserting a first upper joint (210-1) into the upper portion of a first brick hole (110-1) provided on a first brick portion (101), inserting a first lower joint (220-1) into the lower portion of a second brick hole (110-2) provided on a second brick portion (102), inserting a second upper joint (210-2) into the upper portion of the second brick hole (110-2), then inserting the second lower joint (220-2) into the lower portion of a third brick hole (110-3) which is provided on a third brick portion (103).

Further, the third upper joint (210-3) is inserted into the upper portion of a fourth brick hole (110-4) provided on a fourth brick portion (101), a third lower joint (210-3) is inserted into the lower portion of a second brick hole-1 (110-22) provided on the second brick portion (102), a fourth upper joint (210-4) is inserted into the upper portion of the second brick hole-1 (110-22), and, a fourth lower joint (210-4) is inserted into the lower portion of a fifth brick hole (110-5) provided on a fifth brick portion (105).

FIG. 8 through FIG. 10 are drawings which illustrate the characteristics and benefits of the brick structures (1-1) of the present invention. While the illustrations represent the case of a brick structure (1-1) according to a second prototype, they apply identically to the brick structure (1) according to the first prototype as well.

Referring to FIG. 8, the brick structure (1-1) according to the present invention is characterized in that, by having different joints (200) which fit into an hourglass shaped brick hole (110) become fastened to each other inside the hole, the positions of each of the brick portions (100) making up the brick structure (1-1) are stably secured in place.

Accordingly, even in cases in which part of the brick structure (1-1) is damaged, such as a case whereby a hole (h) is formed therein, the components around the damaged area can maintain a stable state without collapsing.

Further, referring to FIG. 9, in a case where the fastening structure of the joint (200) is achieved using screws and threads, the brick structure (1-1) of the present invention is characterized by stacking interval (d) of the brick portions (100) being readily adjustable by altering the fastening interval (d) of the vertically fastened joints (200).

Accordingly, by adjusting the fastening interval (d) between joints (200) fastened between the same levels, and thereby having a plurality of the brick portions (100) forming a layer with identical stacking intervals (d), the brick portions (100) which are stacked can readily be made level.

Further, in cases in which the brick structure (1-1) is installed in a space where it is spaced a certain distance from a ceiling or a floor, the height of the overall brick structure can be adjusted by altering the stacking interval (d), making the brick structure compatible for use with various spacings without having to be cut Here, the brick structure (1-1) can be provided with intervals so as to allow better ventilation, and a bonding agent such as cement mortar may be applied between the interval-adjusted layers to provide a better seal.

Further, referring to FIG. 10, in a case where two of the brick structure (1-1) according to the present invention are arranged, the pair of brick structures (1-1) may form a single connected dual brick structure.

To this end, the assembly-type brick set of the present invention may further comprise a linking member (600) which links the pair of brick structures (1-1).

The linking member (600) may be a thin plate-shaped linking member on which is formed a pair of link holes (610) penetrating either end, and may be around 2 mm in thickness.

In the case of the brick structure (1-1) according to a second prototype of the present invention, the linking member (600) may be provided between a first brick portion (101) and a second brick portion (102) which are stacked vertically adjacent to each other, where the external fastener (520) of the joint (200) penetrates the link hole (610).

Here, the inner diameter (d4) of the link hole (610) is formed to be greater than the outer diameter (d5) of the fastening structure of the outer fastener (520).

Accordingly, the brick structure (1-1) is assembled with the link hole (600) hung around the joint (200) between the first brick portion (101) and the second brick portion (102), and by assembling the linking member (600) between like levels of the pair of brick structures (1-1), the pair of brick structures (1-1) are linked and the interval between them is fixed.

The linking member (600) may be made of highly rigid material such as re-bar to improve securing force, and by adjusting the spacing between the pair of link holes (610), the spacing between the pair of brick structures (1-1) may be adjusted.

Further, a plurality of the linking members (600) may be provided, with the plurality of linking members (600) assembled side by side between the pair of brick structures (1-1) to secure the pair of brick structures (1-1) in a parallel arrangement.

Further, the space between the pair of brick structures (1-1) may be filled with insulating material, etc., to improve the functionality of the dual brick structure (3).

Further, in the case of the brick structure (1) according to a first prototype of the present invention, the linking member (600) has the same configuration as the above brick structure (1-1), but the joint (200) which is assembled between the two different brick portions (100) layered vertically adjacent to each other penetrates the link hole (610) (not illustrated).

Here, the inner diameter (d4) of the link hole (610) is formed to be greater than the greatest horizontal width of the joint (200), that is, the width (d1, see FIG. 2) of the top portion of the brick hole (100).

Further, as illustrated in FIG. 11, the brick structure (1-1) according to the present invention may be assembled so that joints (200) are inserted only into some of the plurality of brick holes (110) provided on the brick portions (100), and the remaining brick holes (110) left empty (E).

In the above case, the number of joints (200) used in constructing a brick structure can be reduced by half, yielding economic benefits in the form of cost savings.

Further, just the joint ring may be inserted (260) into the empty brick holes (110(E)) from the joint (200), excluding the joint body (270).

Here, by using an inexpensive material for the joint ring (260), economic benefits in the form of cost savings may be achieved.

Further, by insertion of the joint ring (260), the uneven inner space of the empty brick hole (110(E)) comes to take on a cylindrical shape, and thereby the inner space formed by the empty brick hole (110(E)) may be used to insert a supporting pole (400, see FIG. 4) or a bonding agent (410, see FIG. 4) or as a path for water or sewage pipes or electric wire.

Further, as illustrated in FIG. 12, the brick structure (1-1) according to the present invention may be assembled so that joint members (200) of a first material (P1) are inserted into some of the plurality of brick holes (110) provided on the brick portions (100), and joint members (200) of a second material (P2) are inserted into the remaining brick holes (110).

In such cases, by using a highly rigid but expensive material such as steel as the first material (P1), and a relatively weaker but inexpensive material such as aluminum as the second material (P2), a compromise wherein adequate durability of the brick structure (1-1) and cost savings are both achieved can be reached.

Further, as illustrated in FIG. 13 and FIG. 14, cores (710, 720) may be embedded into the brick portion (100) according to the present invention.

The core (710, 720) may comprise horizontal cores (710) which are embedded at the top and bottom of the brick portion (100) around the horizontal edges, and vertical cores (720) which link and support the embedded horizontal cores (710). The vertical cores (720) may be embedded into each of the vertical edges of the brick portion (100).

Thereby, a brick which has high resistance to pressure applied in the horizontal and vertical directions has low failure rates, and outstanding durability may be ensured.

The core (710, 720) may be plate-shaped (see FIG. 13), or may be cylindrical (see FIG. 14).

As explained in the foregoing, according to the present invention, an assembly-type brick set which not only maximizes structural rigidity and fastening performance but is also able to, by excluding use of brittle bonding agent such as concrete mortar, prevent damage and collapse of a wall even in cases of severe shaking such as during earthquakes, can be provided.

The present invention is not limited by the prototypes described in the above, and may be carried out in modified forms which are self-evident to a person with ordinary skill in the area to which the present invention belongs, without departing from the technical idea of the present invention as claimed in the appended claims. Such modifications shall be included in the scope of the present invention.

What is claimed is:

1. An assembly-type brick set comprising:

a brick portion in which is formed at least one brick hole which penetrates a brick body vertically, and a joint which is inserted into the brick hole, wherein the brick hole formed in the brick portion has an hourglass shape with vertical symmetry in that a middle portion in a height direction of the brick hole has a diameter smaller than a diameter of an upper portion and a diameter of a lower portion;

wherein the upper portion is defined by a first inclined sidewall in that an inner diameter of the upper portion steadily decreases from a top end of the brick hole toward the middle portion;

wherein the lower portion is defined by a second inclined sidewall in that an inner diameter of the lower portion steadily decreases from a bottom end of the brick hole toward the middle portion; and wherein a top area of the upper portion has the same diameter as a bottom area of the lower portion;

the joint is formed in that a top end of the joint fits into the bottom end of the brick hole and that a bottom end of the joint fits into the top end of the brick hole, wherein the top end of a first of a plurality of the joints is adapted to intermesh with the bottom end of a second of the plurality of the joints such that the bottom end of the first joint inserted into the upper portion of the brick hole and the top end of the second joint inserted into the lower portion of the brick hole are vertically fastened together inside the brick hole;

wherein a first of a plurality of the brick portions is adapted to be stacked to a second of the brick portions to be joined together; and wherein an assembled brick structure is achieved by inserting the lower portion of the joint into the upper portion of any one of the at least one brick holes formed in the first brick portion and inserting the upper portion of the joint into the lower portion of any one of the at least one brick holes formed in the second brick portion.

2. The assembly-type brick set according to claim 1 is characterized in that the brick hole is formed with axial symmetry about a vertical axis.

3. The assembly-type brick set according to claim 1 is characterized in that the fastening structure is achieved by means of intermeshing prominences and depressions.

4. The assembly-type brick set according to claim 1 is characterized in that the fastening structure is achieved by means of intermeshing screws and threads.

5. The assembly-type brick set according to claim 4 is characterized in that a supporting pole which is inserted vertically in the joint path is provided.

6. The assembly-type brick set according to claim 1 is characterized in that a joint hole which penetrates the joint vertically is provided, and a joint path is formed by connecting the joint holes provided on two different joints which are fastened vertically.

7. The assembly-type brick set according to claim 1 is characterized in that:

a thin plate-shaped linking member on which is formed a pair of link holes penetrating either end is provided;

the linking member is provided between the first brick portion and the second brick portion so that the joint penetrates the link hole and is assembled to the first brick portion and the second brick portion; and in an arrangement in which a pair of brick structures are arranged side by side, the pair of link holes are respectively assembled to the same level of each of the pair of brick structures, thereby linking the pair of brick structures and achieving a double brick structure.

8. The assembly-type brick set according to claim 7 is characterized in that the linking member is length-adjustable.

9. The assembly-type brick set according to claim 1 is characterized in that the joint comprises a column-shaped joint body and a ring-shaped joint ring, with the joint body penetrating the joint ring.

10. The assembly-type brick set according to claim 1 is characterized in that the fastening structure is achieved by means of intermeshing prominences and depressions.

11. The assembly-type brick set according to claim 1 is characterized in that the fastening structure is achieved by means of intermeshing screws and threads.

12. The assembly-type brick set according to claim 11 is characterized in that a supporting pole which is inserted vertically in the joint path is provided.

* * * * *